US007701318B2

(12) United States Patent
Ayusawa

(10) Patent No.: US 7,701,318 B2
(45) Date of Patent: Apr. 20, 2010

(54) IGNITION COIL AND IGNITION DEVICE FOR INTERNAL COMBUSTION ENGINE

(75) Inventor: Takuma Ayusawa, Numazu (JP)

(73) Assignee: Kokusan Denki Co., Ltd., Shizuoka-Ken (JP)

( * ) Notice: Subject to any disclaimer, the term of this patent is extended or adjusted under 35 U.S.C. 154(b) by 179 days.

(21) Appl. No.: 11/789,153

(22) Filed: Apr. 24, 2007

(65) Prior Publication Data

US 2007/0246029 A1 Oct. 25, 2007

(30) Foreign Application Priority Data

Apr. 24, 2006 (JP) ..... 2006-118708

(51) Int. Cl.
*H01F 27/29* (2006.01)

(52) U.S. Cl. ..... 336/192

(58) Field of Classification Search ..... 336/65, 336/83, 90–96, 107, 192; 123/634–635
See application file for complete search history.

(56) References Cited

U.S. PATENT DOCUMENTS 5,729,505 A * 3/1998 Murata et al. ..... 336/178

FOREIGN PATENT DOCUMENTS

JP 08-306557 11/1996

* cited by examiner

*Primary Examiner*—Tuyen Nguyen
(74) *Attorney, Agent, or Firm*—Pearne & Gordon LLP

(57) ABSTRACT

An ignition coil for an internal combustion engine includes: an iron core; a primary coil wound around the iron core via a primary bobbin; a secondary coil provided to externally surround the primary coil; a ground terminal fitting placed with a part thereof being held between the primary bobbin and the iron core; and a resin-molded portion provided to cover the primary coil and the secondary coil, a ground side terminal portion of the primary coil being connected to the ground terminal fitting, wherein at least one protrusion is formed in the part of the ground terminal fitting held between the primary bobbin and the iron core, and the protrusion has a pointed tip that is brought into contact with the iron core.

10 Claims, 4 Drawing Sheets

IGNITION COIL AND IGNITION DEVICE FOR INTERNAL COMBUSTION ENGINE

BACKGROUND OF THE INVENTION

The present invention relates to an ignition coil for an internal combustion engine and an ignition device for an internal combustion engine using the ignition coil.

PRIOR ART OF THE INVENTION

As known, an ignition coil for an internal combustion engine is comprised of an iron core, a primary coil wound around the iron core via a primary bobbin, and a secondary coil placed outside the primary coil, and constitutes an ignition device for an internal combustion engine together with a primary current control unit. The primary current control unit is constituted by components of a primary current control circuit mounted to a circuit board and resin-molded, or accommodated in a predetermined package, the primary current control circuit having a function of causing a sudden change in primary current of the ignition coil at ignition timing of the engine. A known primary current control circuit includes a current interruption circuit or a capacitor discharge circuit.

When the primary current control unit causes a sudden change in primary current of the ignition coil, a high voltage is induced in the primary coil of the ignition coil. This voltage is increased by a ratio of voltage increase between the primary and secondary coils of the ignition coil, and thus a high voltage for ignition is induced in the secondary coil of the ignition coil. The high voltage for ignition induced in the secondary coil is applied to an ignition plug mounted to a cylinder of the engine through a high-tension code electrically connected at one end to a high potential terminal portion of the secondary coil.

In the ignition device for an internal combustion engine, an iron core of the ignition coil is used as a ground potential portion, and a ground side terminal portion of the primary coil is connected to the iron core together with a ground wire of the control unit. Depending on constructions of the primary current control circuit, one end of the secondary coil is sometimes grounded to the iron core together with the ground side terminal portion of the primary coil.

In order to connect a ground side terminal portion of a primary coil to an iron core, Japanese Patent Application Laid-Open Publication No. 8-306557 discloses an ignition coil comprising a ground terminal fitting placed with part thereof being held between a primary bobbin and an iron core, and to which a ground side terminal portion of the primary coil is connected.

FIG. 6 shows an ignition device for an internal combustion engine constituted by incorporating a control unit into the ignition coil disclosed in Japanese Patent Application Laid-Open Publication No. 8-306557. In FIG. 6, a reference numeral 1 denotes an iron core, 2 denotes a primary bobbin mounted to the iron core 1, 3 denotes a primary coil wound around the primary bobbin 2, 4 denotes a secondary bobbin provided to surround the primary coil, and 5 denotes a secondary coil wound around the secondary bobbin 4. A reference numeral 6 denotes a cylindrical high-tension code connecting portion formed integrally with a flange of the primary bobbin 2, and one end of a high-tension code HC is connected to the high-tension code connecting portion. The iron core 1, the primary bobbin 2, the primary coil 3, the secondary bobbin 4, and the secondary coil 5 constitute the ignition coil. A reference numeral 7 denotes a control unit that controls a primary current of the ignition coil, and 8 denotes a case that houses essential portions of the ignition coil together with the control unit 7.

A reference numeral 9 denotes a ground terminal fitting, part of which is held between the primary bobbin 2 and the iron core 1, and a ground side terminal portion 3*a* of the primary coil 3 and a ground wire 7*a* extended from the control unit 7 are soldered to the ground terminal fitting.

FIG. 7 shows, in an enlarged manner, the ground terminal fitting used in the ignition device in FIG. 6. As shown in FIG. 7, in the ignition coil disclosed in Japanese Patent Application Laid-Open Publication No. 8-306557, the part 9*a* of the ground terminal fitting 9 held between the primary bobbin and the iron core has two parallel cuts, inner portions of the cuts are diagonally raised to form a protrusion 9*b* having a flat tip (linearly extending in a width direction), and the tip of the protrusion 9*b* is brought into contact with the iron core 1.

An ignition coil for an internal combustion engine is often placed in an environment of exposure to rainwater, and a primary coil and a secondary coil are generally resin-molded for weatherization. When a control unit is provided together with the ignition coil, the control unit is resin-molded together with the ignition coil, and the resin-molded ignition coil and control unit constitute an ignition device for an internal combustion engine. When a case 8 is provided as shown in FIG. 6, resin is poured into the case 8 to form a resin-molded portion.

In the ignition coil or the ignition device in which part of the ground terminal fitting 9 is held between the primary bobbin and the iron core to bring the protrusion 9*b* provided in the ground terminal fitting into contact with the iron core, thereby grounding the terminal portion or the like of the primary coil of the ignition coil to the iron core as described above, resin is apt to enter between the tip of the protrusion 9*b* of the ground terminal fitting and the iron core 1 in forming the resin-molded portion, and thus the ground terminal fitting 9 is often insulated from the iron core 1. Thus, in such an ignition coil or an ignition device, a high voltage is applied between the ground terminal fitting and the iron core after the formation of the resin-molded portion to pass a current in the resin having entered between the protrusion of the ground terminal fitting and the iron core, and thus carbonize the resin and electrically connect the ground terminal fitting and the iron core.

However, as disclosed in Japanese Patent Application Laid-Open Publication No. 8-306557, when the protrusion 9*b* provided in the ground terminal fitting 9 has the flat tip, resin is apt to enter between the tip of the protrusion 9*b* and the iron core 1, and a large amount of resin is sometimes placed between the protrusion 9*b* and the iron core 1. Thus, when the high voltage is applied between the ground terminal fitting and the iron core, a current passing through the resin placed between the protrusion 9*b* and the iron core 1 spreads, preventing a large current from being passed in a concentrated manner. This prevents the resin having entered between the protrusion of the ground terminal fitting and the iron core from being carbonized, and prevents electrical conduction between the ground terminal fitting and the iron core.

Even when a large amount of resin has entered between the protrusion 9*b* of the ground terminal fitting and the iron core 1, the resin can be carbonized by applying an excessively high voltage between the ground terminal fitting and the iron core, but too high a voltage applied between the ground terminal fitting and the iron core increases a load on an insulation portion of the ignition coil, which is not preferable.

SUMMARY OF THE INVENTION

An object of the present invention is to provide an ignition coil for an internal combustion engine that ensures electrical conduction between a ground terminal fitting and an iron core without applying an excessively high voltage therebetween.

An another object of the present invention is to provide an ignition device using an ignition coil for an internal combustion engine that ensures electrical conduction between a ground terminal fitting and an iron core without applying an excessively high voltage therebetween.

The present invention is applied to an ignition coil for an internal combustion engine including: an iron core; a primary coil wound around the iron core via a primary bobbin; a secondary coil provided to externally surround the primary coil; a ground terminal fitting placed with part thereof being held between the primary bobbin and the iron core; and a resin-molded portion provided to cover the primary coil and the secondary coil, a ground side terminal portion of the primary coil being connected to the ground terminal fitting.

In the present invention, at least one protrusion protruding toward the iron core is formed in the part of the ground terminal fitting held between the primary bobbin and the iron core, and the protrusion has a pointed tip that is brought into contact with the iron core.

The present invention is also applied to an ignition device for an internal combustion engine including: an ignition coil including an iron core, a primary coil wound around the iron core via a primary bobbin, a secondary coil provided to externally surround the primary coil, and a ground terminal fitting placed with part thereof being held between the primary bobbin and the iron core; a control unit that constitutes a control circuit that is placed outside the secondary coil and controls a primary current of the ignition coil; and a resin-molded portion provided to cover the primary coil and the secondary coil together with the control unit, a ground side terminal portion of the primary coil and a ground wire connected to the ground of the control unit being connected to the ground terminal fitting.

Also in this case, at least one protrusion protruding toward the iron core is formed in the part of the ground terminal fitting held between the primary bobbin and the iron core, and the protrusion has a pointed tip that is brought into contact with the iron core.

As described above, the protrusion provided in the ground terminal fitting has the pointed tip to prevent resin from entering between the protrusion of the ground terminal fitting and the iron core in forming the resin-molded portion. This can reduce the probability that resin enters between the protrusion of the ground terminal fitting and the iron core to cause insulation therebetween.

As described above, according to the present invention, the probability that resin enters between the protrusion of the ground terminal fitting and the iron core to cause insulation therebetween can be reduced, but resin entering therebetween cannot be completely prevented. Thus, a process of applying a high voltage between the ground terminal fitting and the iron core to carbonize the resin placed therebetween cannot be omitted. However, in the present invention, the protrusion of the ground terminal has the pointed tip, and even if resin enters between the protrusion of the ground terminal fitting and the iron core, a current can be reliably concentrated between the protrusion of the ground terminal fitting and the iron core when the high voltage is applied therebetween. Thus, the resin having entered between the protrusion of the ground terminal fitting and the iron core can be reliably carbonized, thereby ensuring electrical conduction between the ground terminal fitting and the iron core. In this case, the voltage applied between the ground terminal and the iron core may be lower than a voltage required in a processing for conduction between a ground terminal fitting and an iron core in a conventional ignition coil, thereby allowing a processing for electrical conduction between the ground terminal fitting and the iron core to be performed without placing an excessive load on an insulation portion of the ignition coil.

As described above, according to the present invention, the protrusion protruding toward the iron core is formed in the part of the ground terminal fitting held between the primary bobbin and the iron core, the ground terminal fitting being used for connecting the ground side terminal portion of the primary coil to the iron core, and the protrusion has the pointed tip. This prevents resin from entering between the protrusion of the ground terminal fitting and the iron core in forming the resin-molded portion. This can reduce the probability that a large amount of resin enters between the protrusion of the ground terminal fitting and the iron core to cause insulation therebetween.

According to the present invention, the protrusion of the ground terminal fitting has the pointed tip, and even if resin enters between the protrusion of the ground terminal fitting and the iron core, a current can be reliably concentrated between the protrusion of the ground terminal fitting and the iron core by the application of the high voltage between the ground terminal fitting and the iron core, and thus the resin having entered between the protrusion of the ground terminal fitting and the iron core can be reliably carbonized, thereby ensuring electrical conduction between the ground terminal fitting and the iron core.

BRIEF DESCRIPTION OF THE DRAWINGS

The above and other objects and features of the invention will be apparent from the detailed description of the preferred embodiment of the invention, which is described and illustrated with reference to the accompanying drawings, in which.

DETAILED DESCRIPTION OF THE PREFERRED EMBODIMENTS

Now, a preferred embodiment of the present invention will be described in detail with reference to FIGS. 1 to 5.

Figure 1:
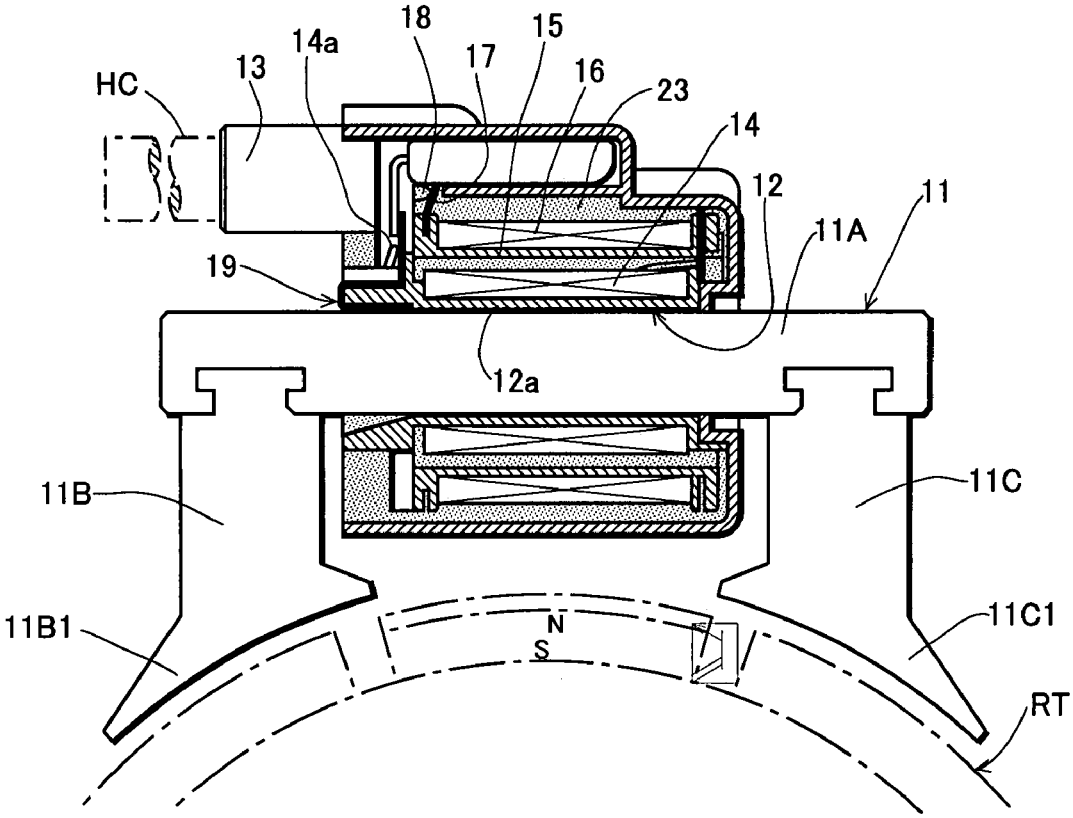
FIG. 1 is a vertical sectional view of a construction of an embodiment of the present invention.
Figure 2:
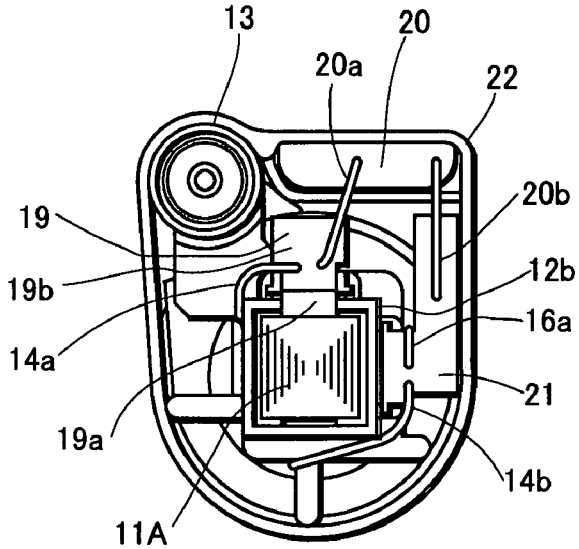
FIG. 2 is a left side view of FIG. 1 with part of an iron core being omitted.

In FIGS. 1 and 2, a reference numeral 11 denotes an iron core made of laminated steel sheets, and the shown iron core 11 is comprised of an I-shaped iron core body 11A, and legs 11B and 11C dovetail-jointed to opposite ends of the iron core body 11A. In tips of the legs 11B and 11C, magnetic pole portions 11B1 and 11C1 are formed that face magnetic poles of a magnetic field provided on an outer periphery of a rotor RT mounted to a crankshaft of an internal combustion engine.

A reference numeral 12 denotes a primary bobbin made of a resin mold, and a cylindrical high-tension code connecting portion 13 is formed integrally with one end of the primary bobbin 12. The primary bobbin 12 has a coil winding barrel 12*a* around which a primary coil 14 is wound. A hole having a square section is formed in an inner side of the barrel 12*a* of the primary bobbin 12. The iron core body 11A is fitted in the hole and thus the primary bobbin 12 around which the primary coil 14 is wound is mounted to the iron core 11.

A reference numeral 15 denotes a cylindrical secondary bobbin placed to externally surround the primary coil 14, and a secondary coil 16 is wound around the secondary bobbin. One end of the secondary coil 16 is connected to a non-ground terminal portion of the primary coil 14, and the other end of the secondary coil 16 is connected to a contact segment 17 secured to a flange provided at one end of the secondary bobbin 15. The contact segment 17 is brought into contact with a head of a secondary terminal 18 in the form of a wood screw mounted to an end of the high-tension code connecting portion 13. One end of the high-tension code HC is inserted into the high-tension code connecting portion 13, and a core of the high-tension code is brought into contact with the secondary terminal 18 in the high-tension code connecting portion.

In order to connect the ground side terminal portion of the primary coil 14 to the iron core 11, a ground terminal fitting 19 formed by bending a conductive plate is mounted to a protruding portion 12*b* of a rectangular column shape formed by extending one end of the coil winding barrel 12*a* of the primary bobbin before the iron core 11 is mounted.

Figure 4:
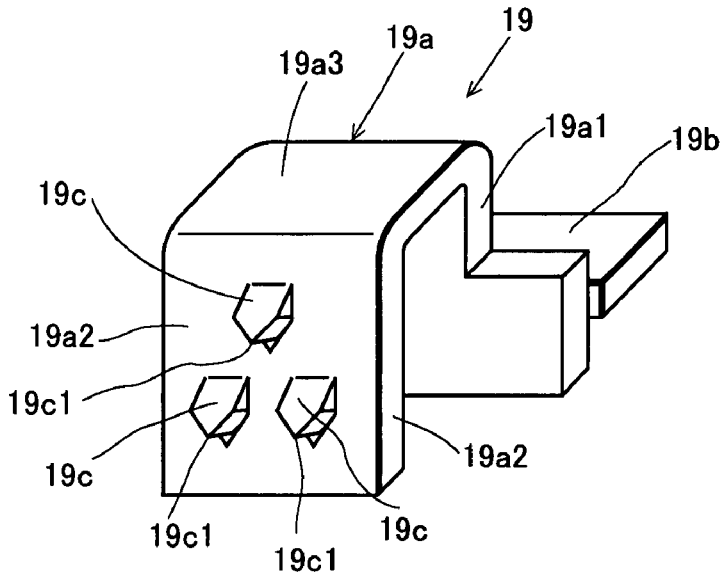
FIG. 4 is a perspective view of an example of a shape of a ground terminal fitting used in the embodiment.

As shown in FIG. 4, the ground terminal fitting 19 integrally has a U-shaped portion 19*a* constituted by a pair of plate portions 19*a*1 and 19*a*2 placed in parallel with each other and a connecting portion 19*a*3 connecting one ends of the plate portions, and a flat-shaped terminal portion 19*b* extending from the other end of the plate portion 19*a*1 of the U-shaped portion 19*a* perpendicularly to the plate portion 19*a*1. Cuts of a home-plate shape having triangular tips are formed in the other plate portion 19*a*2 of the U-shaped portion 19*a*, and inner portions of the cuts are diagonally raised outward of the U-shaped portion 19*a* to form protrusions 19*c* each having a pointed tip 19*c*1. At least one protrusion 19*c* may be formed, but in the shown example, three protrusions 19*c* are formed and placed at three vertices of a triangle.

Figure 3:
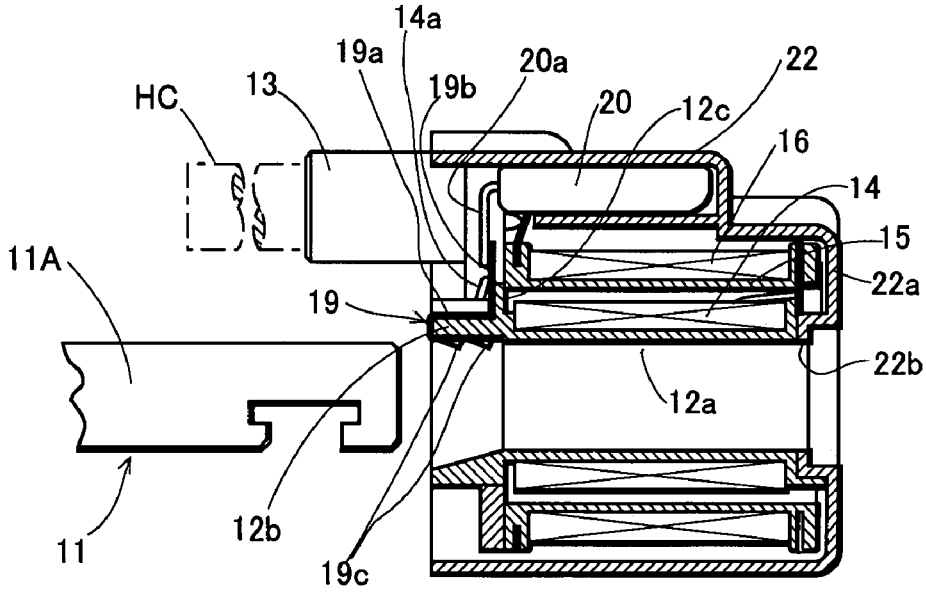
FIG. 3 is a vertical sectional view of a state before the iron core is mounted to a primary bobbin in the embodiment.

As shown in FIG. 3, the ground terminal fitting 19 is placed so that the protrusions 19*c* formed in the plate portion 19*a*2 of the U-shaped portion 19*a* diagonally protrude inward of the primary bobbin 12 (toward the iron core), the U-shaped portion 19*a* is fitted to the protruding portion 12*b* of the rectangular column shape formed in one end of the primary bobbin 12 and thus mounted to the primary bobbin 12, and the terminal portion 19*b* is placed along a flange 12*c* provided at one end of the primary bobbin 12. A ground side terminal portion 14*a* of the primary coil 14 and a ground wire 20*a* extended from a control unit 20 provided outside the secondary coil 16 are soldered to the terminal portion 19*b* of the ground terminal fitting 19. As shown in FIG. 2, a terminal plate 21 is secured to the other end of the primary bobbin 12, and a non-ground side terminal portion 14*b* of the primary coil 14, a terminal portion 16*a* at one end of the secondary coil 16, and a lead 20*b* extended from the control unit 20 are soldered to the terminal plate 21.

A reference numeral 22 denotes a resin case having an opening at one end and a bottom 22*a* at the other end. Essential portions of an ignition coil including the primary bobbin 12 around which the primary coil 14 is wound and the secondary bobbin 15 around which the secondary coil 16 is wound, and the control unit 20 are inserted in the case. In this state, the iron core body 11A is inserted into the barrel 12*a* of the primary bobbin 12. The iron core body 11A is placed so that one end thereof protrudes outward from the opening of the case 22, and the other end thereof is lead out through a hole 22*b* formed in the bottom 22*a* of the case 22. When the iron core body 11A is thus mounted, the plate portion 19*a*2 of the ground terminal fitting 19 is held between the primary bobbin and the iron core body, and the pointed tips 19*c*1 of the protrusions 19*c* formed in the plate portion 19*a*2 are brought into contact with the iron core body 11A.

Then, resin is poured into the case 22 to form a resin-molded portion 23 in which the essential portions of the ignition coil and the control unit 20 are embedded.

Figure 5:
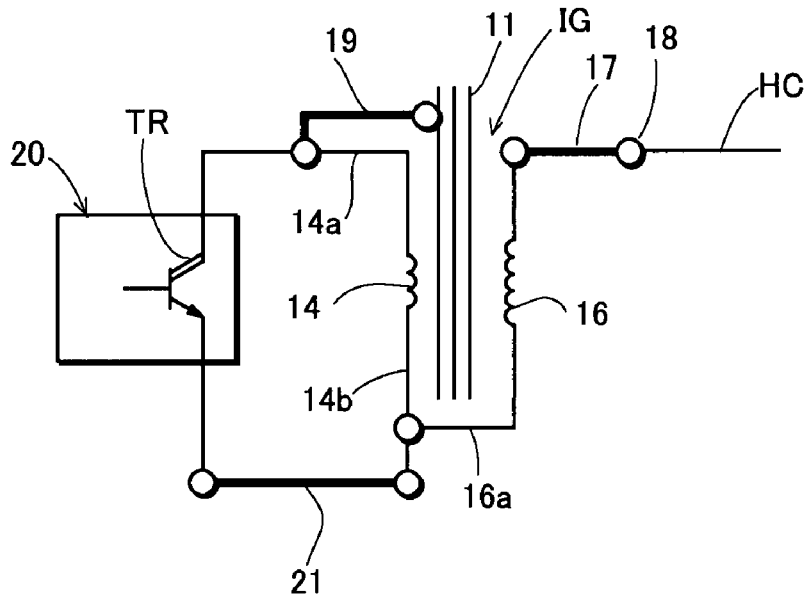
FIG. 5 is a schematic circuit diagram of an electrical construction of an ignition device comprised of an ignition coil and a control unit in the embodiment.
Figure 6:
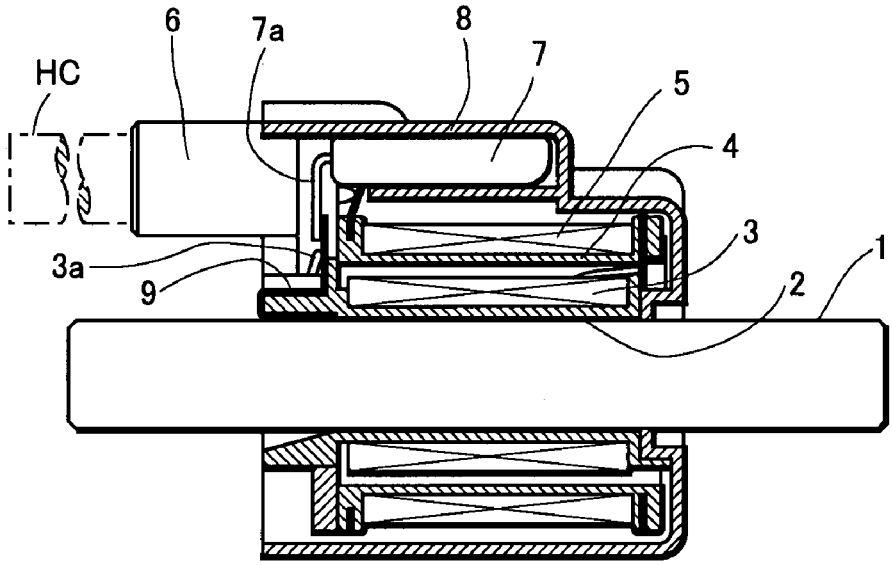
Fig. 6 Prior Art
FIG. 6 is a vertical sectional view of a construction of a conventional ignition device.
Figure 7:
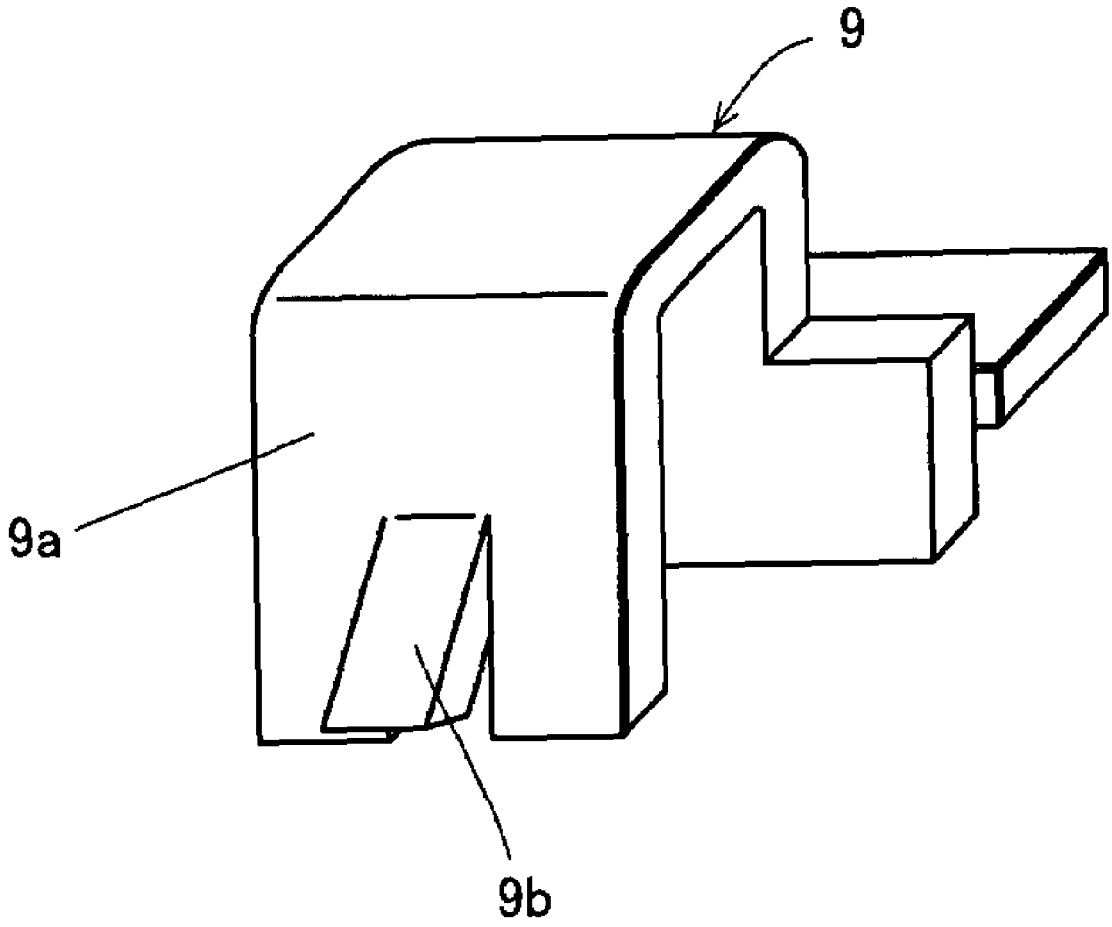
Fig. 7 Prior Art
FIG. 7 is a perspective view of a ground terminal fitting used in the conventional ignition device.

FIG. 5 shows the control unit 20. The control unit is a known current interruption type unit comprising an NPN primary current control transistor TR, and an unshown control circuit that turns on/off the transistor. A collector of the transistor TR is connected to the ground side terminal portion of the primary coil 14, and an emitter thereof is connected to the non-ground side terminal portion of the primary coil 14 and one end on a low potential side of the secondary coil 16.

The unshown control circuit provided in the control unit 20 passes a base current through the transistor TR to bring the transistor into conduction in a half cycle (a half cycle of a polarity at which a ground side potential of the primary coil 14 is higher than a non-ground side potential) of an AC voltage induced in the primary coil 14 by rotation of the rotor Rt, and passes a primary current from the primary coil 14 through between the collector and the emitter of the transistor TR. The control circuit also detects a primary current from a voltage between the collector and the emitter of the transistor TR, and stops supply of the base current to the transistor TR when detecting that the primary current reaches a predetermined level to interrupt the transistor TR. This interrupts the primary current having been passing, induces a high voltage in the primary coil of the ignition coil by a transient phenomenon, and increases the voltage by a ratio of voltage increase between the primary and secondary coils, thereby inducing a high voltage for ignition in the secondary coil 16.

As described above, the protrusion 19*c* provided in the ground terminal fitting has the pointed tip 19*c*1 to prevent resin from entering between the protrusion 19*c* of the ground terminal fitting 19 and the iron core 11 in forming the resin-molded portion 23. This can reduce the probability that resin enters between the protrusion of the ground terminal fitting 19 and the iron core to cause insulation therebetween.

Even if resin enters between the protrusion of the ground terminal fitting and the iron core, a current can be reliably concentrated between the pointed tip 19*c*1 of the protrusion of the ground terminal fitting and the iron core 11 by the application of the high voltage between the ground terminal fitting 19 and the iron core 11, and thus the resin having entered between the protrusion of the ground terminal fitting and the iron core can be reliably carbonized, thereby ensuring electrical conduction between the ground terminal fitting and the iron core. In this case, the voltage applied between the ground terminal and the iron core may be lower than a voltage required in a processing for conduction between a ground terminal fitting and an iron core in a conventional ignition coil, thereby allowing a processing for electrical conduction between the ground terminal fitting and the iron core to be performed without placing an excessive load on an insulation portion of the ignition coil.

In the above description, the control unit 19 including the current interruption circuit is used, but the control unit 19 of other types may be used such as the one including a capacitor discharge circuit. In the above described embodiment, an ignition device for an internal combustion engine is comprised by incorporating the control unit into the case housing the ignition coil, but the present invention may be, of course, applied to an ignition coil provided separately from the control unit 19.

In the above described embodiment, the present invention is applied to the ignition coil in which the iron core has the magnetic pole portions 11B1 and 11C1, and the magnetic pole portions face the magnetic poles of the rotor (magnet rotor) mounted to the engine to induce the voltage in the primary coil 14 (the primary coil is used as a power supply), but the present invention may be applied to the case where a power supply that passes a primary current through an ignition coil is provided outside. In this case, the legs 11B and 11C in FIG. 1 are omitted.

Although the preferred embodiment of the invention has been described and illustrated with reference to the accompanying drawings, it will be understood by those skilled in the art that it is by way of examples, and that various changes and modifications may be made without departing from the spirit and scope of the invention, which is defined only to the appended claims.

What is claimed is:

1. An ignition coil for an internal combustion engine comprising:

an iron core;

a primary coil wound around said iron core via a primary bobbin;

a secondary coil provided to externally surround said primary coil;

a ground terminal fitting placed with a part thereof being held between said primary bobbin and said iron core; and a resin-molded portion provided to cover said primary coil and said secondary coil, a ground side terminal portion of said primary coil being connected to said ground terminal fitting, wherein at least one protrusion protruding toward said iron core is formed in the part of said ground terminal fitting held between said primary bobbin and said iron core, and said protrusion has a sharp-pointed tip that is brought into contact with said iron core.

2. An ignition device for an internal combustion engine comprising:

an ignition coil including an iron core, a primary coil wound around said iron core via a primary bobbin, a secondary coil provided to externally surround said primary coil, a ground terminal fitting placed with a part thereof being held between said primary bobbin and said iron core;

a control unit that constitutes a control circuit that is placed outside said secondary coil and controls a primary current of said ignition coil; and a resin-molded portion provided to cover said primary coil and said secondary coil together with said control unit, a ground side terminal portion of said primary coil and a ground wire connected to the ground of said control unit being connected to said ground terminal fitting, wherein at least one protrusion protruding toward said iron core is formed in the part of said ground terminal fitting held between said primary bobbin and said iron core, and said protrusion has a sharp-pointed tip that is brought into contact with said iron core.

3. The ignition coil of claim 1, wherein the ground terminal portion includes a plurality of protrusions.

4. The ignition coil of claim 3, wherein the ground terminal portion includes three protrusions.

5. The ignition coil of claim 1, wherein the sharp-pointed tip of the at least one protrusion includes a triangular-shaped tip.

6. The ignition coil of claim 1, wherein the at least one protrusion includes a triangular-shaped tip diagonally raised from a plate portion of the ground terminal fitting.

7. The ignition device of claim 2, wherein the ground terminal portion includes a plurality of protrusions.

8. The ignition device of claim 7, wherein the ground terminal portion includes three protrusions.

9. The ignition device of claim 2, wherein the sharp-pointed tip of the at least one protrusion includes a triangular-shaped tip.

10. The ignition device of claim 2, wherein the at least one protrusion includes a triangular-shaped tip diagonally raised from a plate portion of the ground terminal fitting.

* * * * *